US009371828B2

(12) United States Patent
Tsai

(10) Patent No.: US 9,371,828 B2
(45) Date of Patent: Jun. 21, 2016

(54) EXTERNAL AUTOMATIC CONTROL SMART AIR PUMP

(71) Applicant: DONGGUAN TIGER POINT METAL & PLASTIC PRODUCTS CO., LTD., Guang Dong Province (CN)

(72) Inventor: Chun-Chung Tsai, New Taipei (TW)

(73) Assignee: DONGGUAN TIGER POINT METAL & PLASTIC PRODUCTS CO., LTD., Dongguan (CN)

( * ) Notice: Subject to any disclaimer, the term of this patent is extended or adjusted under 35 U.S.C. 154(b) by 212 days.

(21) Appl. No.: 14/197,839

(22) Filed: Mar. 5, 2014

(65) Prior Publication Data

US 2015/0252809 A1 Sep. 10, 2015

(51) Int. Cl.

| | |
|---|---|
| ***F04D 27/00*** | (2006.01) |
| ***F04B 49/00*** | (2006.01) |
| ***F04D 25/06*** | (2006.01) |
| ***F04D 25/08*** | (2006.01) |
| ***F04D 15/02*** | (2006.01) |
| ***A47C 27/08*** | (2006.01) |

(52) U.S. Cl.

CPC ..... *F04B 49/002* (2013.01); *A47C 27/082* (2013.01); *A47C 27/083* (2013.01); *F04D 15/02* (2013.01); *F04D 25/06* (2013.01); *F04D 25/08* (2013.01); *F04D 27/001* (2013.01); *F04D 27/008* (2013.01)

(58) Field of Classification Search

CPC ..... F04D 25/06; F04D 25/08; F04D 27/008; F04D 15/02; A47C 27/082; A47C 27/083; F04B 49/002; H01H 13/568; H01H 23/12; H01H 3/12

See application file for complete search history.

(56) References Cited

U.S. PATENT DOCUMENTS

| | | | | |
|---|---|---|---|---|
| 2,631,576 | A * | 3/1953 | Schowalter | F01L 1/12 123/90.19 |
| 6,153,838 | A * | 11/2000 | Wadge | H01H 3/20 200/334 |
| 6,181,032 | B1 * | 1/2001 | Marshall | B25F 3/00 200/321 |
| 2005/0158172 | A1 * | 7/2005 | Snyder | F01D 15/10 415/206 |
| 2006/0073040 | A1 * | 4/2006 | Metzger | F04D 25/08 417/423.1 |
| 2008/0286117 | A1 * | 11/2008 | Kehrmann | F04D 25/08 417/1 |
| 2008/0286124 | A1 * | 11/2008 | Sen | F04D 25/084 417/234 |
| 2012/0093662 | A1 * | 4/2012 | Tsai | A47C 27/082 417/44.2 |
| 2012/0129378 | A1 * | 5/2012 | Kiko | H01R 13/717 439/345 |

FOREIGN PATENT DOCUMENTS

| | | | | |
|---|---|---|---|---|
| DE | 4404480 | A1 * | 8/1995 | H01H 13/568 |

* cited by examiner

*Primary Examiner* — Bryan Lettman
*Assistant Examiner* — Thomas Cash
(74) *Attorney, Agent, or Firm* — Rabin & Berdo, P.C.

(57) ABSTRACT

The present invention provides an external automatic control smart air pump, including a housing, an air blast device and an automatic control mechanism. By setting up the intake nozzle in such way that the second cavity is independently in communication therewith, the actual air pressure inside the inflatable object can be precisely measured. The fine motion switch is controlled with the coordination of the push button, rotating position limiting member, pressing member, air pressure sensing film, first restoring spring and second restoring spring, thereby realizing the auto stop control of the air pump. The structure of the present invention is simple, and the assembling process thereof is convenient. In addition, the present invention can be precisely controlled according to the actual air pressure inside the inflatable object, thereby bringing convenience for the user.

9 Claims, 14 Drawing Sheets

EXTERNAL AUTOMATIC CONTROL SMART AIR PUMP

BACKGROUND OF THE INVENTION

1. Field of the Invention

The present invention relates to an air pump, and more particularly, to an external automatic control smart air pump.

2. The Prior Arts

Air pump is an essential component for various types of inflatable objects (e.g. inflatable mattress, inflatable trampoline, inflatable sofa, inflatable toys and etc.), and is usually installed at an internal side of a soft capsule inside an inflatable object so as to inflate the inflatable object rapidly, to preserve the air pressure thereof or to deflate the inflatable object rapidly. In this way, inflatable objects can be expanded for later use, or can be deflated to reduce the size thereof to be stored away.

At present, most of the conventional air pumps on the market, such as the portable air pump, are not equipped with the auto stop function. The user would have to turn the air pump on or off manually, which can be rather inconvenient. In order to overcome this drawback, some portable air pumps are provided with built-in auto stop mechanism; however, the structure of the auto stop mechanism of such air pumps is rather complicated and is difficult to assemble. In addition, the conventional auto stop mechanism cannot be controlled precisely according to the actual air pressure inside the inflatable object, which can cause inconvenience as well.

SUMMARY OF THE INVENTION

A primary objective of the present invention is to provide an external automatic control smart air pump which can overcome the inconvenience in using the conventional small pumps.

For achieving the foregoing objectives, the present invention provides an external automatic control smart air pump, including a housing, an air blast device and an automatic control mechanism.

The housing includes an air chamber. An air inlet, an air outlet and an intake nozzle are disposed on the housing, and the air chamber is in communication with the air inlet and the air outlet.

The air blast device is installed inside the housing. The air blast device includes: an air blast impeller and a dynamo. The air blast impeller is disposed inside the air chamber. An air-inlet side of the air blast impeller faces the air inlet, and an air-outlet side thereof faces the air outlet. The dynamo drives the air blast impeller to rotate.

The automatic control mechanism is installed inside the housing. The automatic control mechanism includes: a casing, a fine motion switch, a push button, a rotating position limiting member, a pressing member and a deformable air pressure sensing film. The fine motion switch is configured to turn on/off the air blast device. The push button is configured to activate the fine motion switch. The rotating position limiting member is configured to limit the position of the push button so as to keep the push button abutting against the fine motion switch. The pressing member is configured to rotate the rotating position limiting member so as to release the push button. The air pressure sensing film is configured to set off the pressing member to rotate the rotating position limiting member. The air pressure sensing film is disposed inside the casing, thereby dividing the casing into a first cavity and a second cavity which are sealed to each other. The first cavity is in communication with the ambient, and the second cavity is in communication with the intake nozzle. A first end of the rotating position limiting member faces the pressing member, and a first restoring spring is disposed at a second end of the rotating position limiting member. The push button is exposed on the housing, and a second restoring spring is disposed for the push button.

According to an embodiment of the present invention, the push button includes a base portion, an operating portion, a pressing portion and a protruding portion. The operating portion is formed on an external surface of the base portion. The pressing portion protrudes from the base portion in a lateral direction, and the protruding portion is formed on an inner side surface of the base portion. The rotating position limit member is rotatably installed on the casing through a screw. The first end of the rotating position limit portion is shaped as a plate, and a hook portion is disposed at the second end of the rotating position limit memeber for hooking the protruding portion.

According to an embodiment of the present invention, two ends of the first restoring spring respectively abuts against the casing and the second end of the rotating position limiting member, and two ends of the second restoring spring respectively abuts against the housing and the push button.

According to an embodiment of the present invention, a handle is formed on the housing, and the push button is exposed on a surface of the handle. The housing includes a left shell, a right shell and a lid. The left shell and the right shell forms a fitting space for fitting the air blast device and the automatic control mechanism, and the lid is installed on the right shell to form the air chamber therewith.

According to an embodiment of the present invention, the dynamo is an AC dynamo. The air blast impeller is installed at an end of a rotary shaft of the AC dynamo, and a heat dissipating impeller is installed at another end of the rotary shaft of the AC dynamo.

According to an embodiment of the present invention, the dynamo is a DC dynamo.

According to an embodiment of the present invention, a battery compartment is disposed on the housing for fitting a dry battery, which provides electricity to the air blast device. A battery compartment lid is disposed on the housing for the battery compartment.

According to an embodiment of the present invention, a rechargeable battery, which provides electricity to the air blast device, is disposed inside the housing. A charging interface, which is exposed on the housing, is disposed on the housing for the rechargeable battery.

According to an embodiment of the present invention, a one-way valve is disposed inside the air outlet, and the intake nozzle is disposed inside the air outlet in the front of the one-way valve.

According to an embodiment of the present invention, the intake nozzle is integrally formed on the housing, and is located at a side of the air outlet.

Based on the above description, the present invention is obviously advantageous over the conventional air pumps. To be more specific, the present invention is advantageous in the following:

I. By setting up the intake nozzle in such way that the second cavity is independently in communication therewith, the actual air pressure inside the inflatable object can be precisely measured. The fine motion switch is controlled with the coordination of the push button, rotating position limiting member, pressing member, air pressure sensing film, first restoring spring and second restoring spring, thereby realizing the auto stop control of the air pump. The structure of the present invention is simple, and the assembling process thereof is convenient. In addition, the present invention can be precisely controlled according to the actual air pressure inside the inflatable object, thereby bringing convenience for the user.

II. The dynamo used in the present invention can be an AC dynamo, which electrically connects with an external AC power source directly, or can also be a DC dynamo, which electrically connects with an external AC power source directly. In addition, the dynamo used in the present invention can also be electrically connected with dry batteries or rechargeable batteries disposed therein. The diversity of the dynamo used in the present invention can fulfill various needs of the users.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
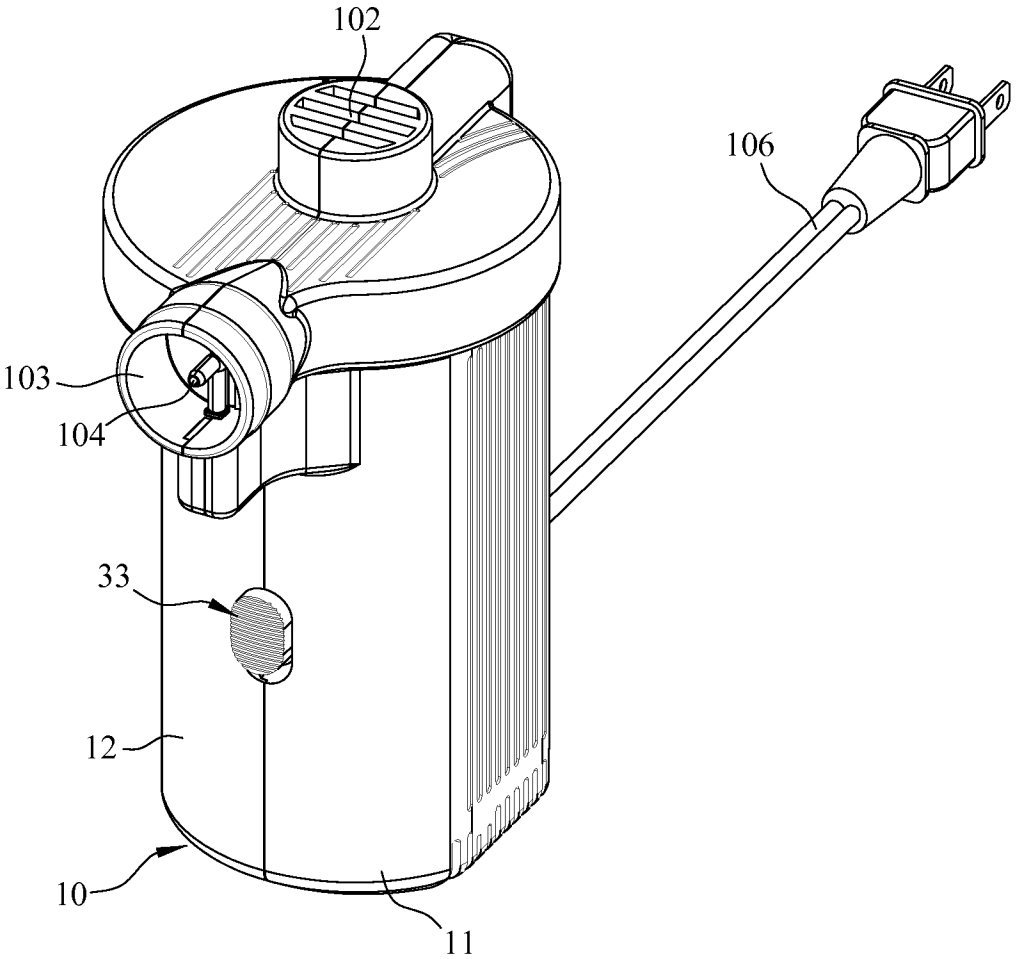
FIG. 1 is a perspective view of a external automatic control smart air pump according to a first embodiment of the present invention.
Figure 2:
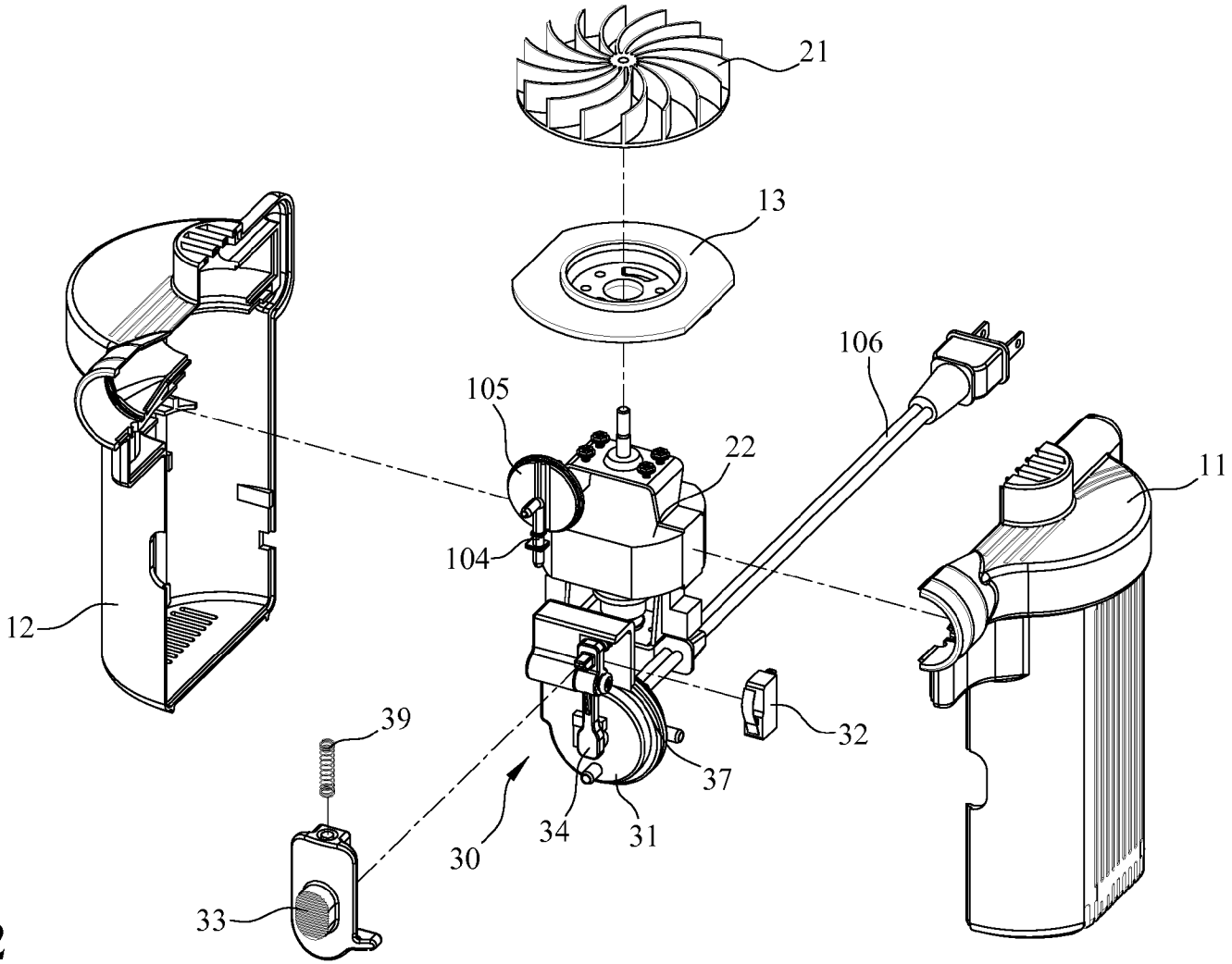
FIG. 2 is an exploded view of the external automatic control smart air pump according to the first embodiment of the present invention.
Figure 3:
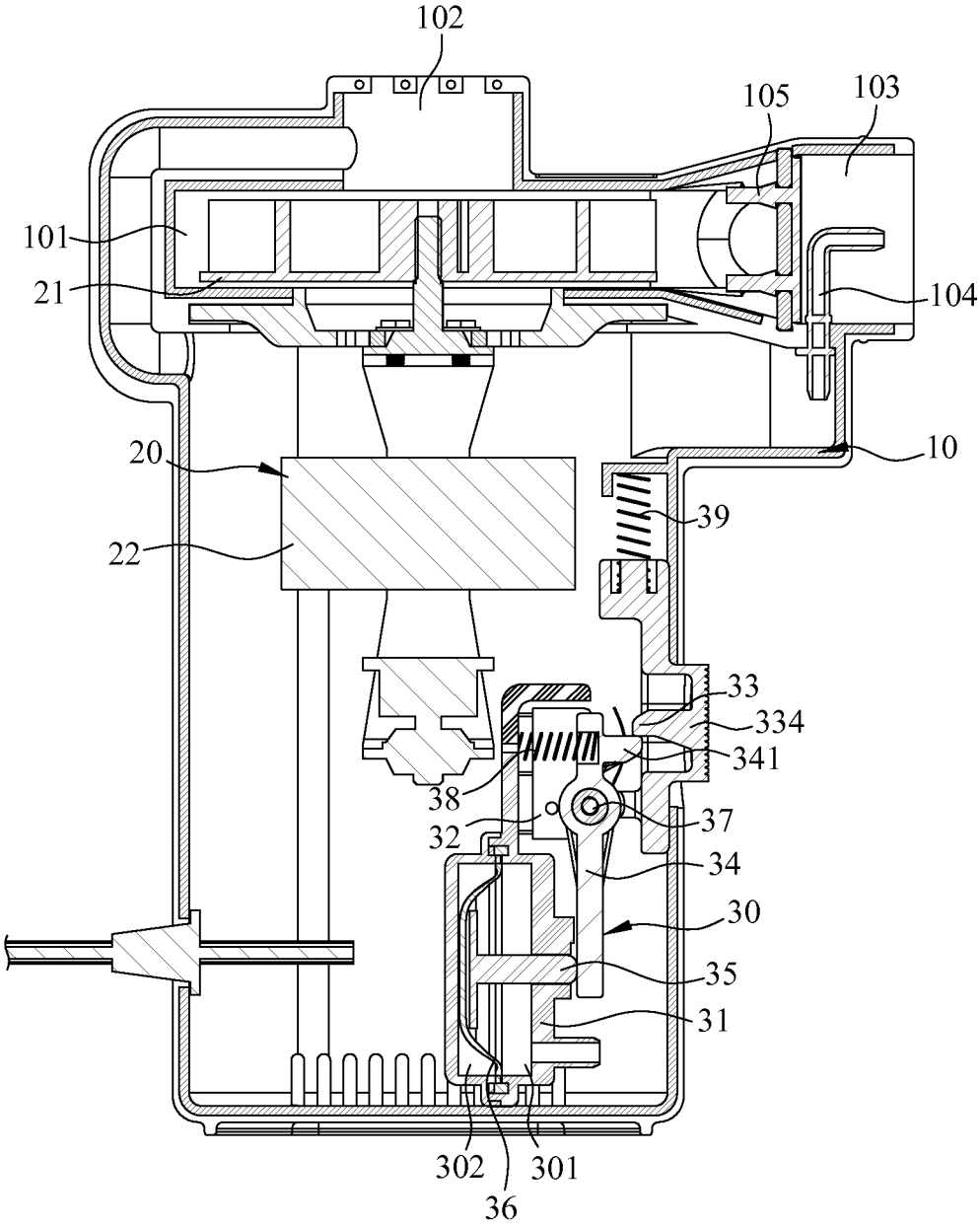
FIG. 3 is a cross-sectional view of the external automatic control smart air pump according to the first embodiment of the present invention.

The accompanying drawings are included to provide a further understanding of the invention, and are incorporated in and constitute a part of this specification. The drawings illustrate embodiments of the invention and, together with the description, serve to explain the principles of the invention.

FIG. 1~FIG. 6 illustrate the structure of an external automatic control smart air pump according to a first embodiment of the present invention. As shown in FIG. 1~FIG. 6, the external automatic control smart air pump includes a housing 10, an air blast device 20 and an automatic control mechanism 30.

The housing 10 includes an air chamber 101. An air inlet 102, an air outlet 103 and an intake nozzle 104, which is for sensing the air pressure inside an inflatable object, are disposed on the housing 10, and the air chamber 101 is in communication with the air inlet 102 and the air outlet 103. To be more specific, in the first embodiment, the housing 10 includes a left shell 11 and a right shell 12. A partition 13 is disposed in the space formed by the left shell 11 and the right shell 12, so as to divide the space formed by the left shell 11 and the right shell 12 to form the air chamber 101. The air inlet 102 is located at a top surface of the housing 10, and the air outlet 103 is located at a side of the top of the housing 10. A one-way valve 105 is disposed inside the air outlet 103, and the intake nozzle 104 is disposed inside the air outlet 103 in the front of the one-way valve 105.

The air blast device 20 is installed inside the housing 10. The air blast device 20 includes: an air blast impeller 21 and a dynamo 22. The air blast impeller 21 is disposed inside the air chamber 101. An air-inlet side of the air blast impeller 21 faces the air inlet 102, and an air-outlet side thereof faces the air outlet 103. The dynamo 22 drives the air blast impeller 21 to rotate. In the first embodiment of the present invention, the dynamo 22 is an AC dynamo, which is electrically connected to an external power outlet through a plug 106. Meanwhile, the dynamo 22 is mounted on the partition 13 through screws.

Figure 4:
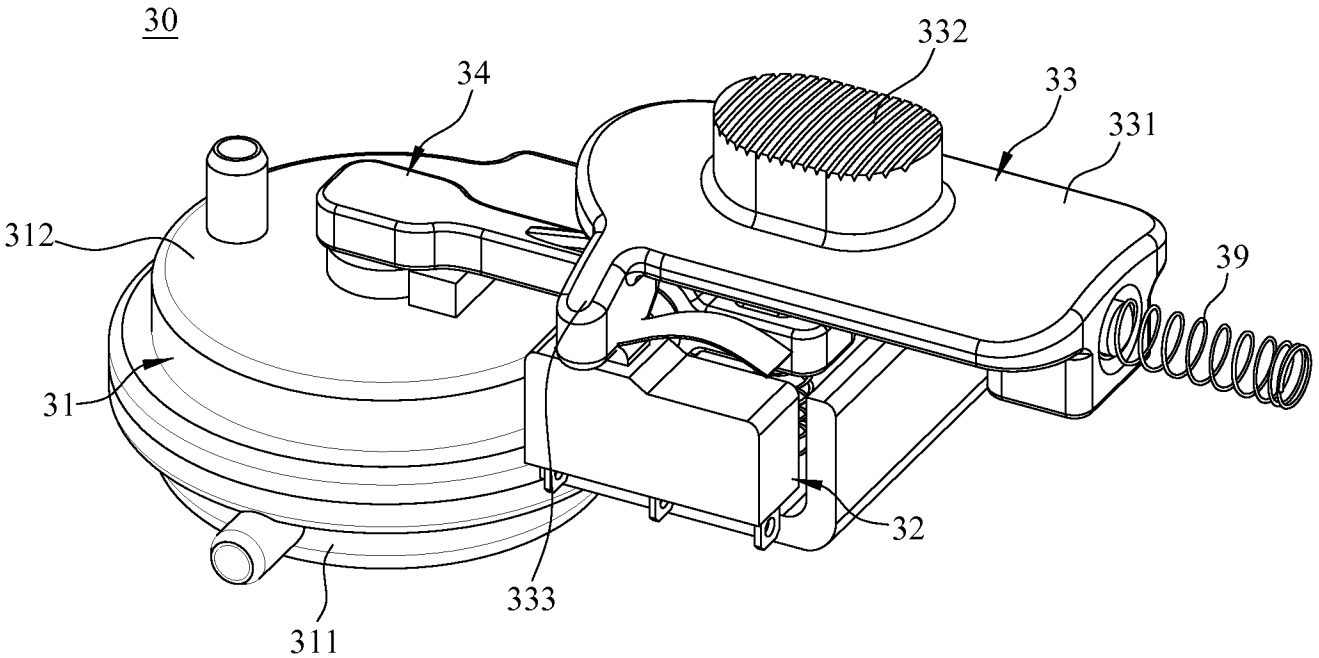
FIG. 4 is a perspective view of a automatic control mechanism according to the first embodiment of the present invention.
Figure 5:
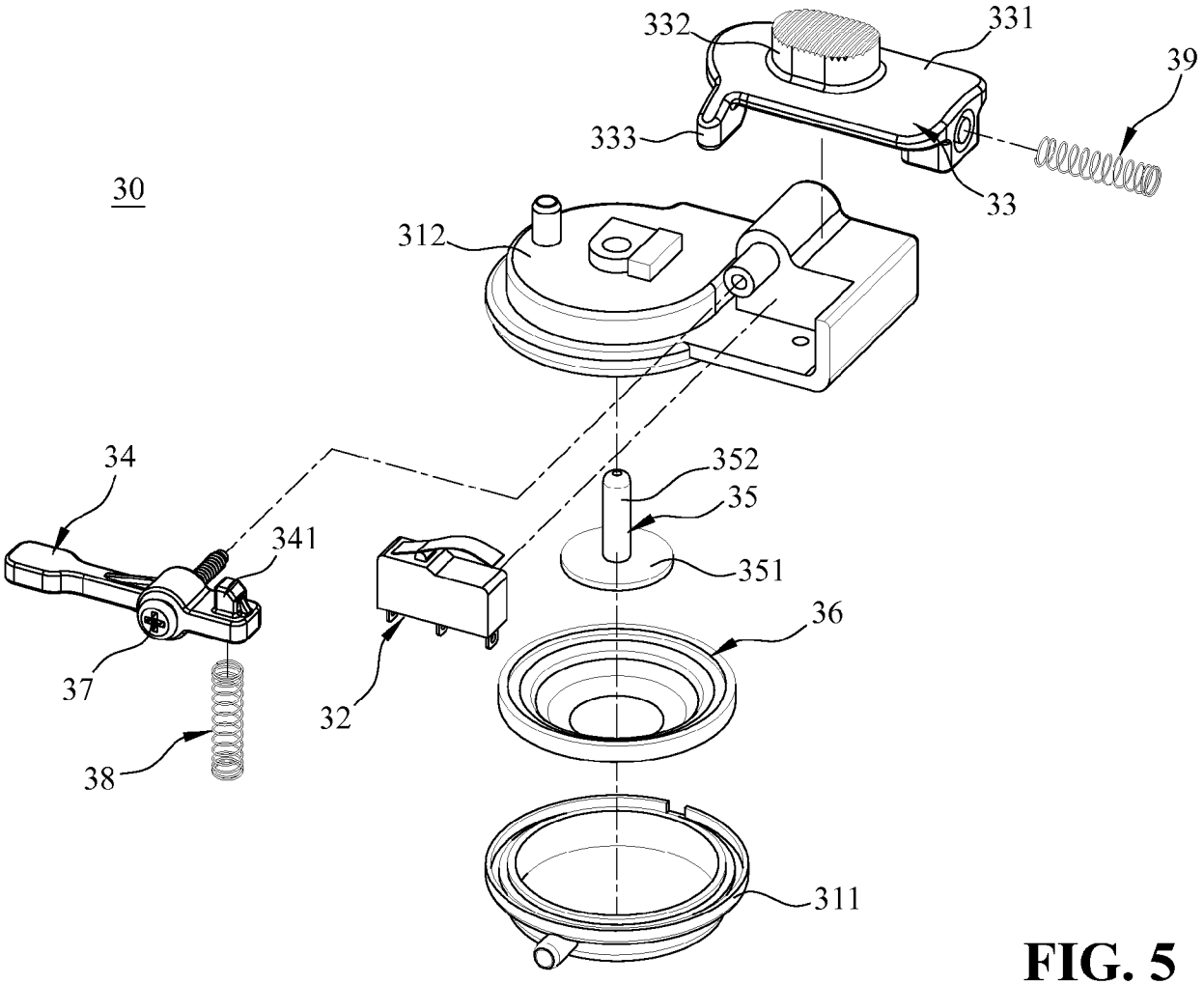
FIG. 5 is an exploded view of the automatic control mechanism according to the first embodiment of the present invention.
Figure 6:
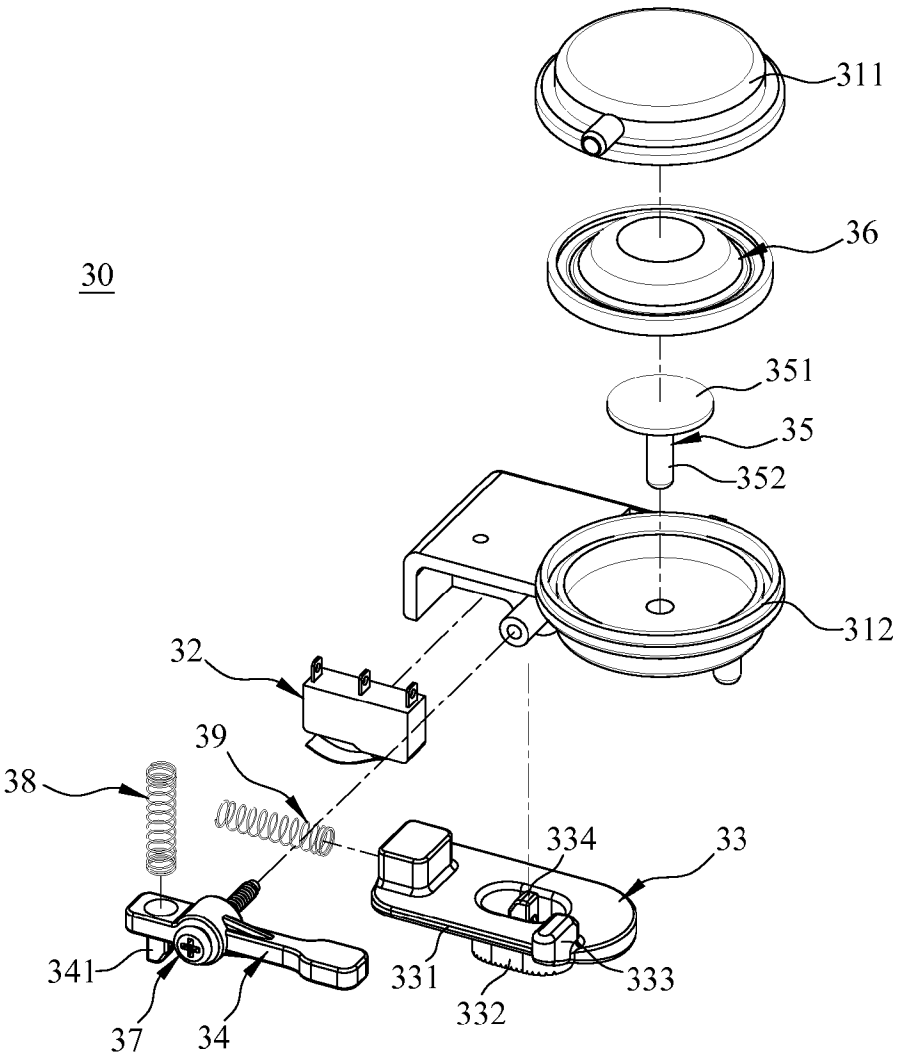
FIG. 6 is an exploded view of the automatic control mechanism from another angle according to the first embodiment of the present invention.

The automatic control mechanism 30 is installed inside the housing 10. As shown in FIG. 4~FIG. 6, the automatic control mechanism 30 includes: a casing 31, a fine motion switch 32, a push button 33, a rotating position limiting member 34, a pressing member 35 and a deformable air pressure sensing film 36. The casing 31 consists of a base 311 and an upper lid 312. The fine motion switch 32 is configured to turn the power of the air blast device 20 on/off. The push button 33 is configured to activate the fine motion switch 32, and is located at a side of the fine motion switch 32. To be more specific, the push button 33 includes a base portion 331, an operating portion 332, a pressing portion 333 and a protruding portion 334. The operating portion 332 is formed on an external surface of the base portion 331. The pressing portion 333 protrudes from the base portion 331 in a lateral direction, and the protruding portion 334 is formed on an inner side surface of the base portion 331. The rotating position limiting member 34 is configured to limit the position of the push button 33 so as to keep the push button 33 abutting against the fine motion switch 32. The rotating position limit member 34 is rotatably installed on the casing 31 through a screw 37. The first end of the rotating position limit portion 34 is shaped as a plate, and a hook portion 341 is disposed at the second end of the rotating position limit portion 34 for hooking the protruding portion 334. The pressing member 35 is configured to rotate the rotating position limiting member 34 so as to release the push button 33. The pressing member 35 includes a position limiting plate 351, and a boss 352 extending from the position limiting plate 351. The air pressure sensing film 36 is configured to set off the pressing member 35 to rotate the rotating position limiting member 34, thereby releasing the hook 341 from the protruding portion 334. The air pressure sensing film 36 is disposed inside the casing 31, thereby dividing the casing 31 into a first cavity 301 and a second cavity 302 which are sealed to each other. The first cavity 301 is in communication with the ambient, and the second cavity 302 is in communication with the intake nozzle 104. In the first embodiment, a first end of the rotating position limiting member 34 faces the pressing member 35, and a first restoring spring 38 is disposed at a second end of the rotating position limiting member 34. The two ends of the first restoring spring 38 respectively abuts against the casing 31 and the second end of the rotating position limiting member 34, where the hook portion 341 on the second end of the rotation position limit member 34 engages the protruding portion 334 of the push button 33. The push button 33 is exposed on the housing 10, and a second restoring spring 39 is disposed for the push button 33. The two ends of the second restoring spring 39 respectively abut against the housing 10 and the push button 33.

In the following section, the operation of the external automatic control smart air pump according to the first embodiment of the present invention will be explained in detail.

When inflating an inflatable object, first, the inflation inlet of the object is connected with the air outlet 103 of the automatic control smart air pump of the present invention. Next, the push button 33 is pushed against the biasing action of the first restoring spring 38 such that the pressing portion 333 abuts against the fine motion switch 32, where the hook portion 341 hooks the protruding portion 334 to keep the pressing portion 333 pressing against the fine motion switch 32. At this moment, the air blast device 20 is turned on, so the dynamo 22 drives the air blast impeller 21 to rotate. The air then forms airflow which enters the air chamber 101 from the air inlet 102, and further enters the inflatable object through the air outlet 103, thereby inflating the inflatable object. As the air pressure inside the inflatable object increases, the airflow enters the second cavity 302 through the intake nozzle 104. The air pressure inside the first cavity 301 is atmospheric pressure. When the air pressure inside the second cavity 302 is greater than the air pressure inside the first cavity, the air pressure sensing film 36 deforms, thereby setting off the pressing member 35. The boss 352 of the pressing member 35 presses against the first end of the rotating position limiting member 34 so as to rotate the rotating position limiting member 34 about the screw 37, wherein the rotating position limiting member 34 further releases the hook portion 341 from the protruding portion 334. With the second restoring spring 39, the push button 33 then releases fine motion switch 32. At this moment, the fine motion switch 32 disconnects the power to turn off the air blast device 20, thereby achieving the auto stop function after the inflation is completed.

Figure 7:
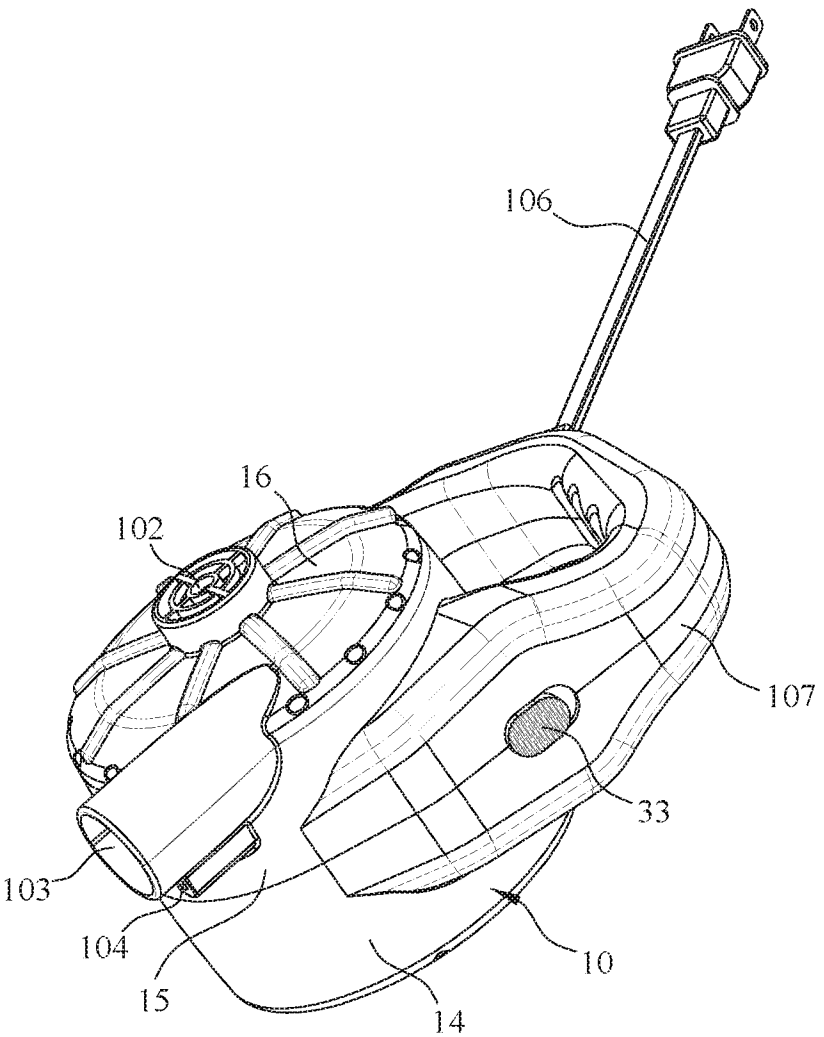
FIG. 7 is a perspective view of the external automatic control smart air pump according to a second embodiment of the present invention.
Figure 8:
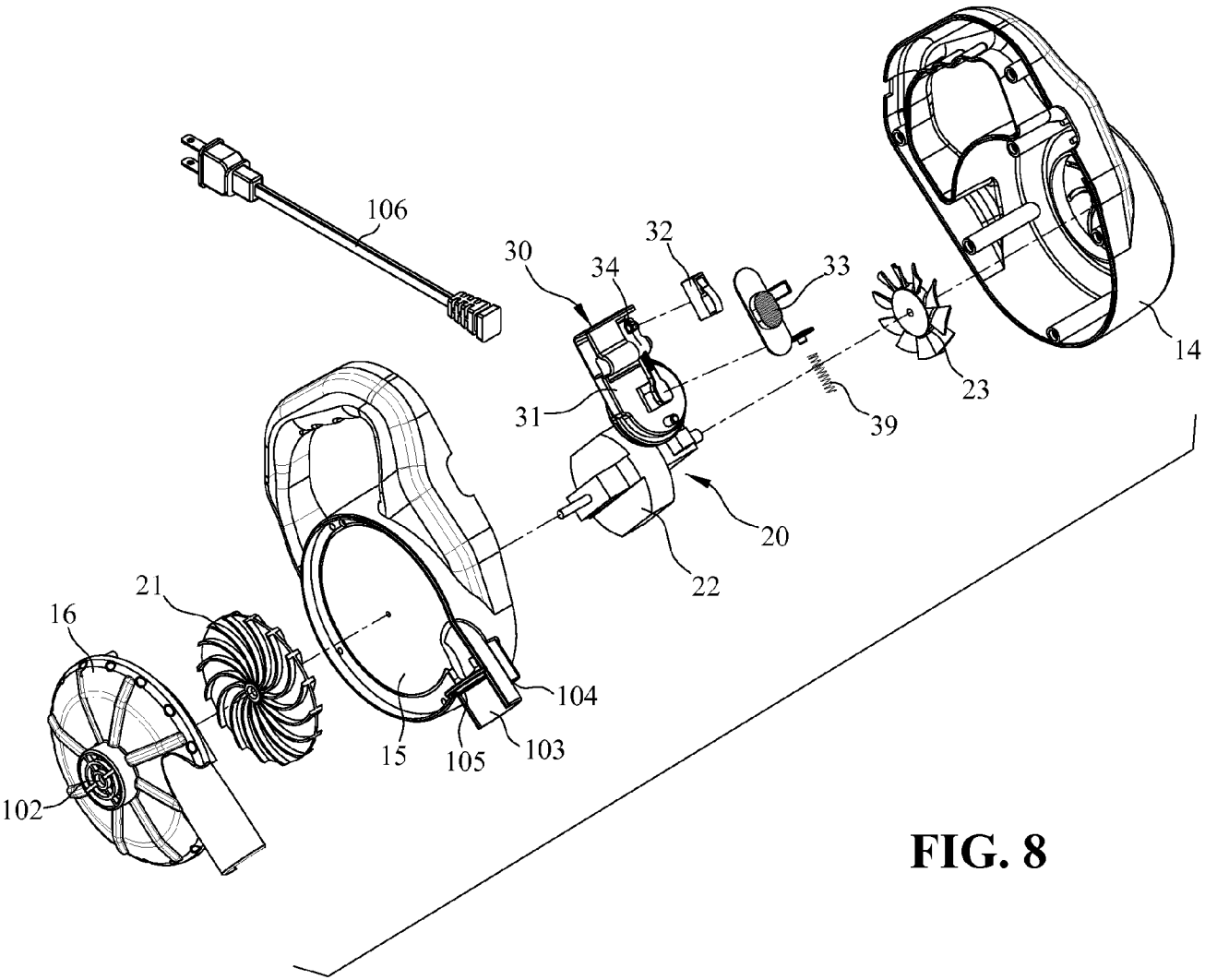
FIG. 8 is an exploded view of the external automatic control smart air pump according to the second embodiment of the present invention.

FIG. 7 and FIG. 8 of the present invention illustrate the structure of the external automatic control smart air pump according to a second embodiment of the present invention. As shown in FIG. 7 and FIG. 8, the structure of the external automatic control smart air pump according to the second embodiment is similar to the structure of the first embodiment. In the following section, only the differences between the second embodiment and the first embodiment are described.

In the second embodiment, a handle 107 is formed on the housing 10 so the user can carry the air pump more easily. The push button 33 is exposed on a surface of the handle 107. The housing 10 includes a left shell 14, a right shell 15 and a lid 16. The left shell 14 and the right shell 15 forms a fitting space for fitting the air blast device 20 and the automatic control mechanism 30. The lid 16 is installed on the right shell 15 to form the air chamber 101 therewith. Furthermore, the dynamo 22 is an AC dynamo adapted to use alternative current of 120V. In the second embodiment, the dynamo 22 is also electrically connected to an external power outlet through a plug 106. The air blast impeller 21 is installed at an end of a rotary shaft of the AC dynamo, and a heat dissipating impeller 23 is installed at another end of the rotary shaft of the AC dynamo. Moreover, the intake nozzle 104 is integrally formed on the housing 10, and is located at a side of the air outlet 103. However, the configuration of the present invention is not limited to the one described above.

The operation of the external automatic control smart air pump according to the second embodiment of the present invention is the same as the operation according to the first embodiment. Therefore, the operation thereof will not be described again.

Figure 9:
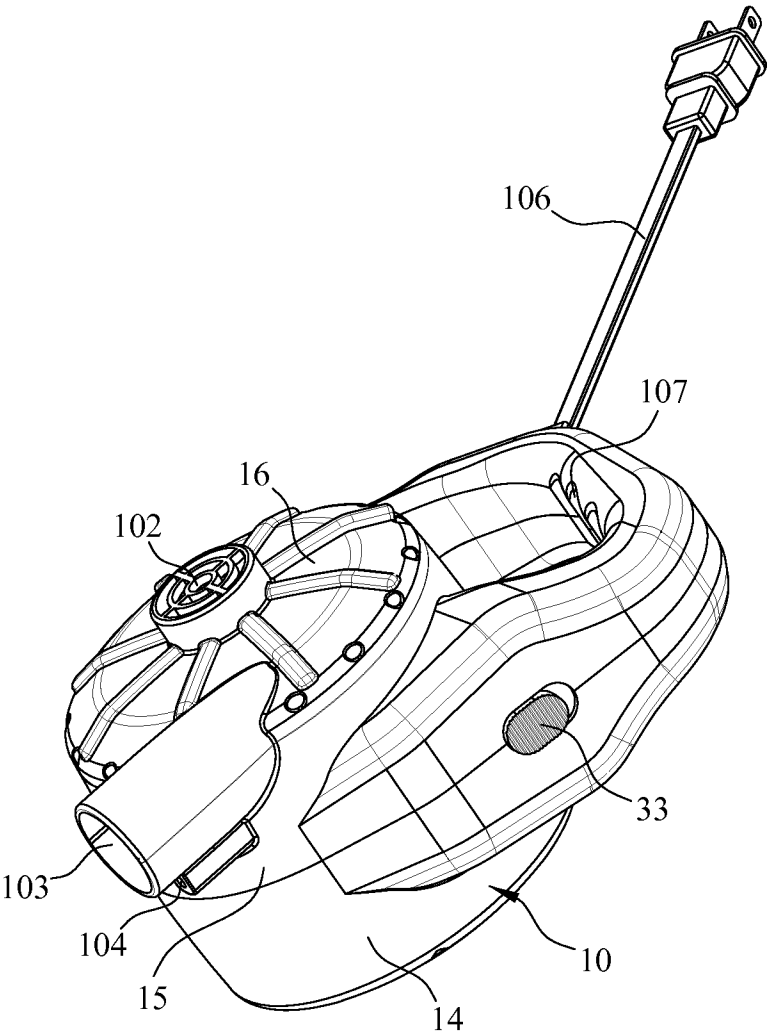
FIG. 9 is a perspective view of the external automatic control smart air pump according to a third embodiment of the present invention.
Figure 10:
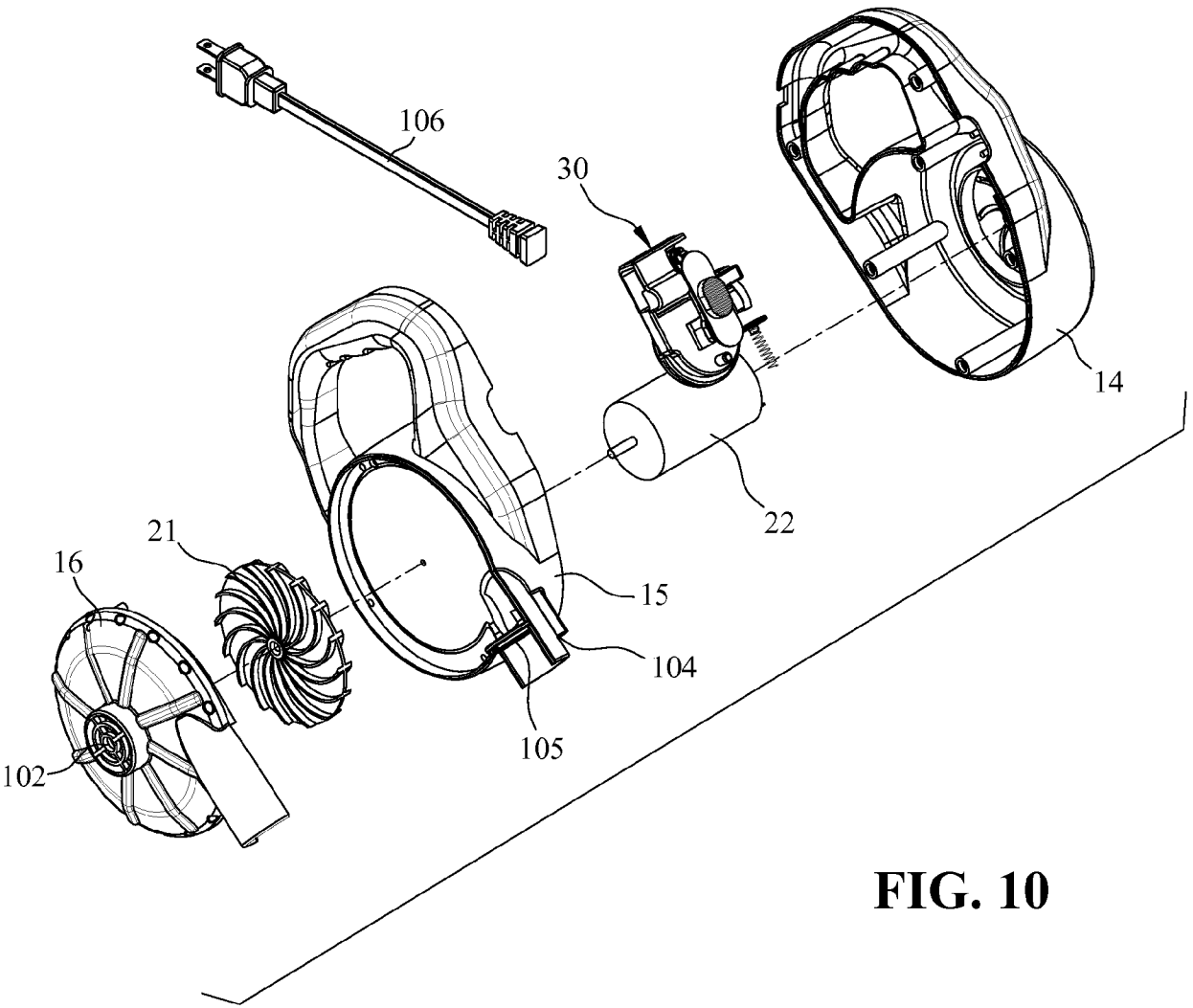
FIG. 10 is an exploded view of the external automatic control smart air pump according to the third embodiment of the present invention.

FIG. 9 and FIG. 10 of the present invention illustrate the structure of the external automatic control smart air pump according to a third embodiment of the present invention. As shown in FIG. 9 and FIG. 10, the structure of the external automatic control smart air pump according to the third embodiment is similar to the structure of the second embodiment. In the following section, only the differences between the third embodiment and the second embodiment are described.

In the third embodiment, the dynamo 22 is a DC dynamo, and is electrically connected to an external power outlet through a plug 106.

The operation of the external automatic control smart air pump according to the third embodiment of the present invention is the same as the operation according to the second embodiment. Therefore, the operation thereof will not be described again.

Figure 11:
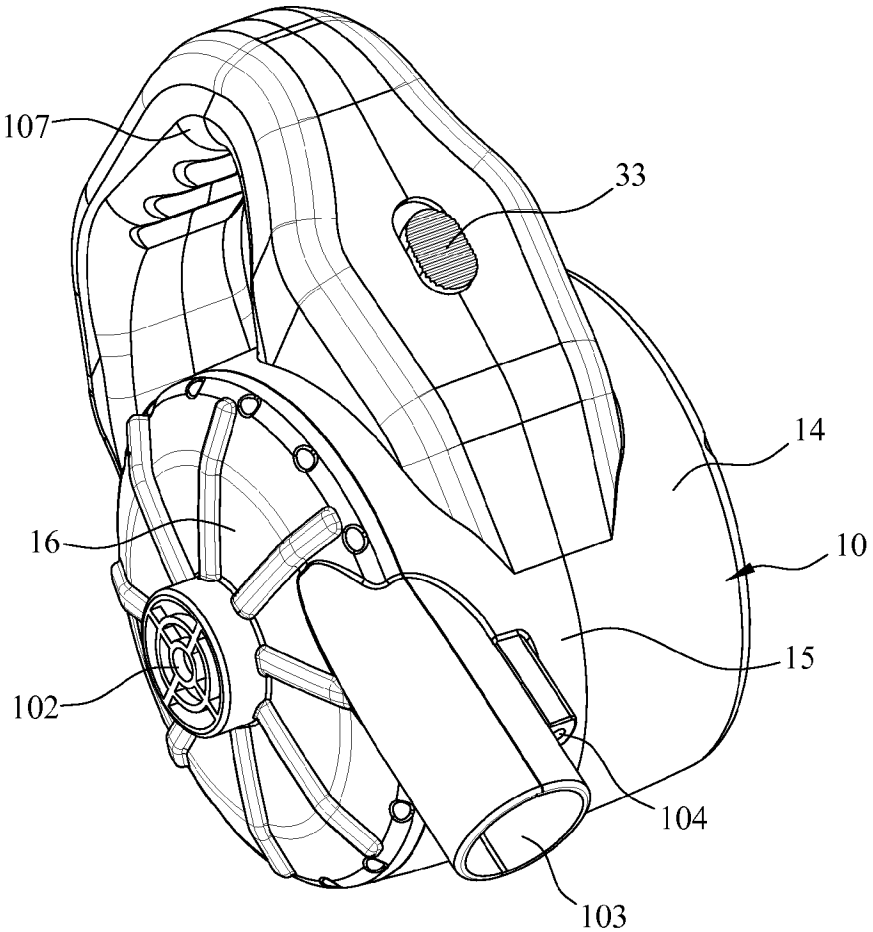
FIG. 11 is a perspective view of the external automatic control smart air pump according to a fourth embodiment of the present invention.
Figure 12:
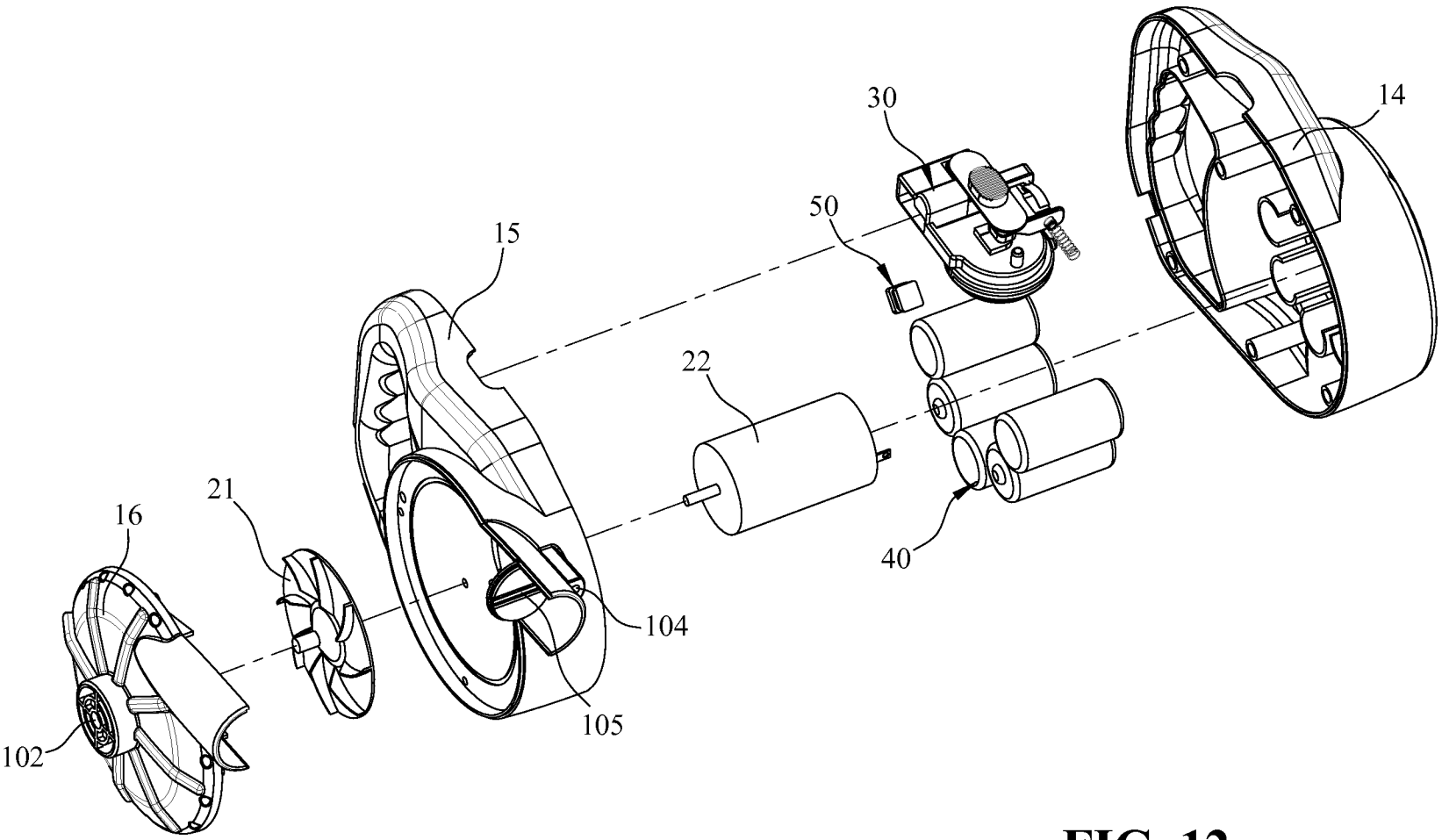
FIG. 12 is an exploded view of the external automatic control smart air pump according to the fourth embodiment of the present invention.

FIG. 11 and FIG. 12 of the present invention illustrate the structure of the external automatic control smart air pump according to a fourth embodiment of the present invention. As shown in FIG. 11 and FIG. 12, the structure of the external automatic control smart air pump according to the fourth embodiment is similar to the structure of the second embodiment. In the following section, only the differences between the fourth embodiment and the second embodiment are described.

In the fourth embodiment, rechargeable batteries 40, which provide electricity to the air blast device 20, is disposed inside the housing 10. A charging interface 50, which is exposed on the housing 10, is disposed on the housing 10 for the rechargeable batteries 40. When the battery is low, the charging interface 50 can be connected to an external power source to charge the rechargeable batteries 40.

The operation of the external automatic control smart air pump according to the fourth embodiment of the present invention is the same as the operation according to the second embodiment. Therefore, the operation thereof will not be described again.

Figure 13:
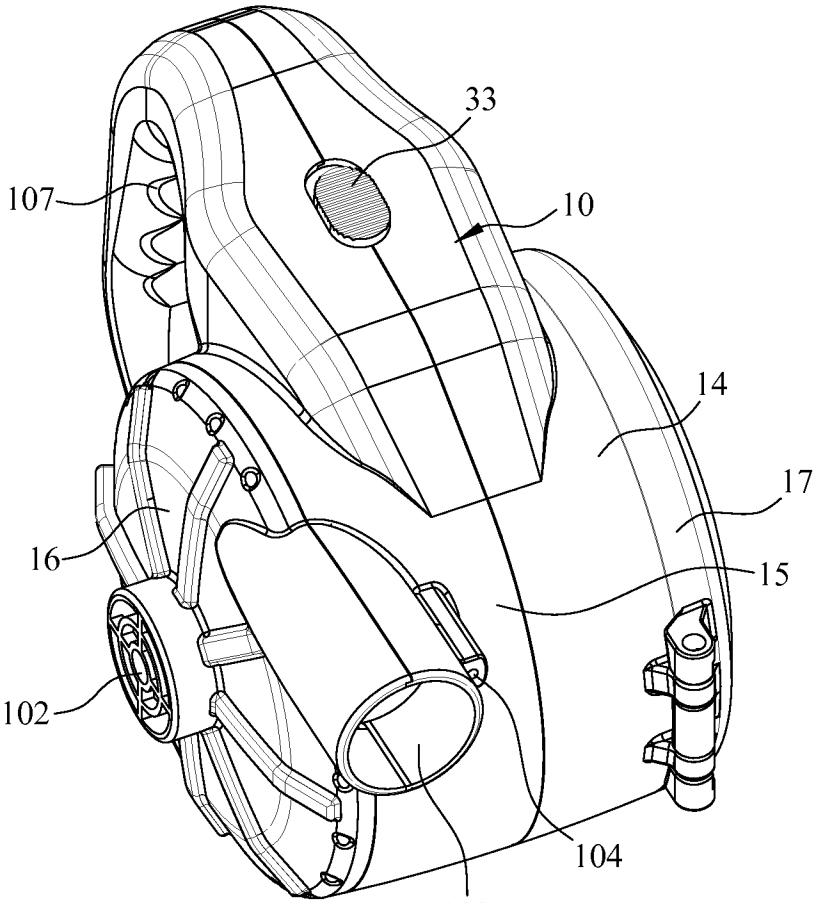
FIG. 13 is a perspective view of the external automatic control smart air pump according to a fifth embodiment of the present invention.
Figure 14:
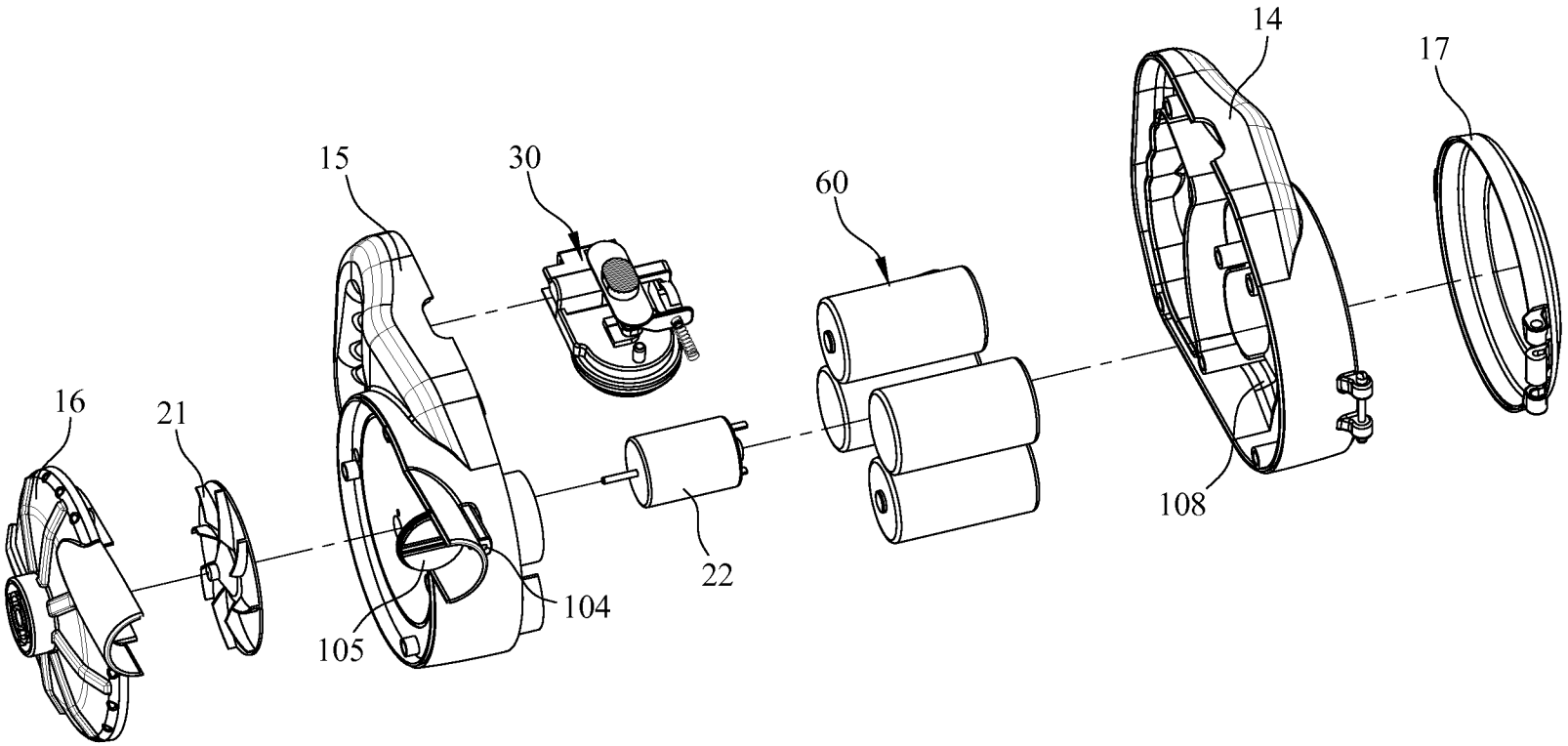
FIG. 14 is an exploded view of the external automatic control smart air pump according to the fifth embodiment of the present invention.

FIG. 13 and FIG. 14 of the present invention illustrate the structure of the external automatic control smart air pump according to a fifth embodiment of the present invention. As shown in FIG. 13 and FIG. 14, the structure of the external automatic control smart air pump according to the fifth embodiment is similar to the structure of the second embodiment. In the following section, only the differences between the fifth embodiment and the second embodiment are described.

In the fifth embodiment, a battery compartment 108 is disposed on the housing 10 for fitting dry batteries 60, which provide electricity to the air blast device 20. A battery compartment lid 17 is disposed on the housing 10 for the battery compartment 108, and is rotatably connected to the left shell 14. When using the external automatic control smart air pump of the present invention, the dry batteries 60 are installed into the battery compartment 108 first, then, the battery compartment lid 17 is closed. In this way, the external automatic control smart air pump of the present invention is ready for use. When the dry batteries 60 are dead, user can simply replace them with new dry batteries.

The operation of the external automatic control smart air pump according to the fifth embodiment of the present invention is the same as the operation according to the second embodiment. Therefore, the operation thereof will not be described again.

The present invention is advantageous in the following points: first, by setting up the intake nozzle in such way that the second cavity is independently in communication therewith, the actual air pressure inside the inflatable object can be precisely measured. The fine motion switch is controlled with the coordination of the push button, rotating position limiting member, pressing member, air pressure sensing film, first restoring spring and second restoring spring, thereby realizing the auto stop control of the air pump. The structure of the present invention is simple, and the assembling process thereof is convenient. In addition, the present invention can be precisely controlled according to the actual air pressure inside the inflatable object, thereby bringing convenience for the user. Secondly, the dynamo used in the present invention can be an AC dynamo, which electrically connects with an external AC power source directly, or can also be a DC dynamo, which electrically connects with an external AC power source directly. In addition, the dynamo used in the present invention can also be electrically connected with dry batteries or rechargeable batteries disposed therein. The diversity of the dynamo used in the present invention can fulfill various needs of the users Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An external automatic control smart air pump, comprising:

a housing, having an air chamber, wherein an air inlet, an air outlet and an intake nozzle are disposed on the housing, and the air chamber is in communication with the air inlet and the air outlet;

an air blast device, installed inside the housing, including:

an air blast impeller, disposed inside the air chamber, wherein an air-inlet side thereof faces the air inlet, and an air-outlet side thereof faces the air outlet; and a dynamo, for driving the air blast impeller to rotate;

an automatic control mechanism, installed inside the housing, including:

a casing;

a fine motion switch, configured to turn on/off the air blast device;

a push button, configured to activate the fine motion switch;

a rotating position limiting member, configured to limit the position of the push button so as to keep the push button abutting against the fine motion switch;

a pressing member, configured to rotate the rotating position limiting member so as to release the push button; and a deformable air pressure sensing film, configured to set off the pressing member to rotate the rotating position limiting member;

wherein the air pressure sensing film is disposed inside the casing, thereby dividing the casing into a first cavity and a second cavity that are sealed to each other;

wherein the first cavity is in communication with the ambient, and the second cavity is in communication with the intake nozzle;

wherein, a first end of the rotating position limiting member faces the pressing member, and a first restoring spring is disposed at a second end of the rotating position limiting member;

wherein the push button is exposed on the housing, and a second restoring spring is disposed for the push button;

wherein the push button includes a base portion, an operating portion, a pressing portion and a protruding portion; wherein the operating portion is formed on an external surface of the base portion, the pressing portion protrudes from the base portion in a lateral direction, and the protruding portion is formed on an inner side surface of the base portion; wherein the rotating position limit member is rotatably installed on the casing through a screw, the first end of the rotating position limit member is shaped like a plate, and a hook portion is disposed at the second end of the rotating position limit member for hooking the protruding portion;

wherein when the push button is pushed, the pressing portion is pressed against a biasing action of the first restoring spring to abut against the fine motion switch such that the hook portion hooks the protruding portion to keep the pressing portion pressing against the fine motion switch, where the air blast device is turned on such that the dynamo drives the air blast impeller to rotate, causing airflow entering the air chamber from the air inlet, and further into an inflatable object through the air outlet, thereby inflating the inflatable object; and wherein deformation of the air pressure sensing film due to pressure within the second cavity being greater than that of the first cavity results in pressing of the pressing member against the rotating position limiting member, causing rotation of the rotating position limiting member about the screw such that the rotating position limiting member releases the hook portion from the protruding portion so that the fine motion switch is released from the push button due to biasing action of the second restoring spring such that the fine motion switch disconnects power to turn off the air blast device, thereby achieving an auto stop function after inflation of the inflatable object is completed.

2. The external automatic control smart air pump according to claim 1, wherein two ends of the first restoring spring respectively abuts against the casing and the second end of the rotating position limiting member, and two ends of the second restoring spring respectively abuts against the housing and the push button.

3. The external automatic control smart air pump according to claim 1, wherein a handle is formed on the housing, and the push button is exposed on a surface of the handle; wherein the housing includes a left shell, a right shell and a lid; wherein the left shell and the right shell forms a fitting space for fitting the air blast device and the automatic control mechanism, and the lid is installed on the right shell to form the air chamber therewith.

4. The external automatic control smart air pump according to claim 1, wherein the dynamo is an AC dynamo, the air blast impeller is installed at an end of a rotary shaft of the AC dynamo, and a heat dissipating impeller is installed at another end of the rotary shaft of the AC dynamo.

5. The external automatic control smart air pump according to claim 1, wherein the dynamo is a DC dynamo.

6. The external automatic control smart air pump according to claim 1, wherein a battery compartment is disposed on the housing for fitting a dry battery, which provides electricity to the air blast device; wherein a battery compartment lid is disposed on the housing for the battery compartment.

7. The external automatic control smart air pump according to claim 1, wherein a rechargeable battery, which provides electricity to the air blast device, is disposed inside the housing; wherein a charging interface, which is exposed on the housing, is disposed on the housing for the rechargeable battery.

8. The external automatic control smart air pump according to claim 1, wherein a one-way valve is disposed inside the air outlet, and the intake nozzle is disposed inside the air outlet in the front of the one-way valve.

9. The external automatic control smart air pump according to claim 1, wherein the intake nozzle is integrally formed on the housing, and is located at a side of the air outlet.

* * * * *